US009364085B2

(12) United States Patent
McCain

(10) Patent No.: US 9,364,085 B2
(45) **Date of Patent: *Jun. 14, 2016**

(54) WINE RACK

(71) Applicant: Wine Master Cellars LLLP, Denver, CO (US)

(72) Inventor: Doug McCain, Castle Rock, CO (US)

(73) Assignee: Wine Master Cellars LLLP, Denver, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/230,933

(22) Filed: Mar. 31, 2014

(65) Prior Publication Data

US 2014/0209549 A1 Jul. 31, 2014

Related U.S. Application Data

(63) Continuation of application No. 13/524,789, filed on Jun. 15, 2012, now Pat. No. 8,684,194, and a continuation of application No. 12/334,374, filed on Dec. 12, 2008, now Pat. No. 8,231,015, and a (Continued)

(51) Int. Cl.
*A47B 73/00* (2006.01)
*A47F 7/28* (2006.01)

(52) U.S. Cl.
CPC ..... *A47B 73/00* (2013.01); *A47B 73/002* (2013.01); *A47F 7/28* (2013.01)

(58) Field of Classification Search
CPC .... A47B 73/00; A47B 73/002; A47B 73/008; A47F 7/28
USPC ..... 211/74, 75, 181.1, 90.03, 106, 54.1, 211/57.1, 59.1, 60.1; D7/701, 707; 248/311.2
See application file for complete search history.

(56) References Cited

U.S. PATENT DOCUMENTS

| | | | | | |
|---|---|---|---|---|---|
| D30,331 | S | | 3/1899 | Walker | |
| 1,039,359 | A | * | 9/1912 | Brown | 211/118 |
| D45,141 | S | * | 1/1914 | Abbath | D6/570 |
| 1,193,666 | A | * | 8/1916 | Combs | 211/58 |
| 1,206,203 | A | * | 11/1916 | Brockway | 248/68.1 |
| 1,227,111 | A | * | 5/1917 | Burdick | 174/158 R |
| 2,018,002 | A | * | 10/1935 | Avery | 211/74 |

(Continued)

FOREIGN PATENT DOCUMENTS

| | | | |
|---|---|---|---|
| DE | 1138902 B | * | 10/1962 |
| DE | 2220154 A1 | * | 11/1972 |

(Continued)

OTHER PUBLICATIONS

Official Action for U.S. Appl. No. 12/334,374, mailed Sep. 2, 2009.

(Continued)

*Primary Examiner* — Stanton L Krycinski
(74) *Attorney, Agent, or Firm* — Sheridan Ross P.C.

(57) ABSTRACT

A wine rack for mounting on a wall or other surface, the wine rack including at least a first and second pair of support members. In one embodiment, the first pair of support members may support at least a first and a second wine bottle in a substantially parallel relation to the wall, wherein the second bottle is positionable proximate the wall, and wherein the label of the first wine bottle is visible to a person standing in front of the wine rack.

14 Claims, 10 Drawing Sheets

Related U.S. Application Data continuation of application No. 11/314,575, filed on Dec. 20, 2005, now Pat. No. 7,850,017, and a continuation of application No. 10/615,638, filed on Jul. 8, 2003, now Pat. No. 6,991,117.

(60) Provisional application No. 60/394,623, filed on Jul. 8, 2002.

(56) References Cited

U.S. PATENT DOCUMENTS

| | | | | | |
|---|---|---|---|---|---|
| 2,222,831 | A | * | 11/1940 | Bitney | 248/91 |
| 2,527,796 | A | | 10/1950 | Clute | |
| 2,558,611 | A | * | 6/1951 | Emmart | 211/74 |
| 3,160,278 | A | * | 12/1964 | Varkala | 211/74 |
| 3,174,628 | A | * | 3/1965 | Kirch, Jr. | 211/123 |
| 3,233,852 | A | * | 2/1966 | Azar | 248/68.1 |
| 3,285,426 | A | | 11/1966 | Wilcke | |
| 3,606,023 | A | * | 9/1971 | Edmunds | 211/74 |
| 3,746,179 | A | * | 7/1973 | Paumgardhen | 211/75 |
| D232,284 | S | | 8/1974 | Shuck | |
| 3,870,155 | A | | 3/1975 | Galloway | |
| D243,738 | S | | 3/1977 | Johnson | |
| 4,094,415 | A | | 6/1978 | Larson | |
| 4,109,795 | A | | 8/1978 | Konigsford et al. | |
| 4,285,449 | A | | 8/1981 | Campos | |
| D260,463 | S | | 9/1981 | Imus | |
| D273,647 | S | | 5/1984 | Kandarian | |
| 4,577,765 | A | | 3/1986 | Crosby | |
| 4,660,727 | A | | 4/1987 | Levine | |
| D289,716 | S | * | 5/1987 | Boland, II | D6/465 |
| 4,795,038 | A | | 1/1989 | Johnson | |
| 4,863,131 | A | | 9/1989 | Kinseley | |
| 4,905,846 | A | | 3/1990 | Calvert | |
| D307,220 | S | * | 4/1990 | Kaufman, Jr. | D6/462 |
| 4,944,415 | A | | 7/1990 | Orbach | |
| 4,998,631 | A | * | 3/1991 | Fridjhon | 211/74 |
| 5,014,949 | A | | 5/1991 | Niven | |
| D319,361 | S | * | 8/1991 | Moser | D6/468 |
| 5,253,837 | A | * | 10/1993 | Loux | 248/250 |
| D351,535 | S | | 10/1994 | Renegar | |
| 5,518,127 | A | * | 5/1996 | Warmack et al. | 211/193 |
| 5,567,029 | A | | 10/1996 | Haenisch et al. | |
| D376,299 | S | * | 12/1996 | Audet | D7/704 |
| 5,597,150 | A | | 1/1997 | Stein et al. | |
| D378,888 | S | | 4/1997 | Bertilsson | |
| D383,364 | S | | 9/1997 | Goodman | |
| D386,363 | S | | 11/1997 | Dardashti | |
| D399,710 | S | | 10/1998 | Brown | |
| 5,826,731 | A | | 10/1998 | Dardashti | |
| 5,836,460 | A | | 11/1998 | Brown et al. | |
| 5,897,003 | A | | 4/1999 | Muhlack | |
| 6,050,426 | A | | 4/2000 | Leurdijk | |
| RE36,827 | E | | 8/2000 | Belokin et al. | |
| 6,386,379 | B1 | | 5/2002 | Battaglia | |
| 6,401,941 | B1 | * | 6/2002 | Maumus | 211/59.1 |
| D460,902 | S | * | 7/2002 | Battle | D7/708 |
| 6,612,448 | B2 | | 9/2003 | Plutsky | |
| D483,233 | S | * | 12/2003 | Chen | D7/704 |
| D497,526 | S | | 10/2004 | Sanders et al. | |
| 6,991,117 | B2 | | 1/2006 | McCain | |
| D543,078 | S | | 5/2007 | Davalos | |
| 7,322,482 | B2 | | 1/2008 | Caradonna | |
| 7,350,647 | B2 | | 4/2008 | Haller et al. | |
| D603,227 | S | | 11/2009 | Gurer | |
| 7,828,160 | B2 | | 11/2010 | Lin | |
| 7,850,017 | B2 | | 12/2010 | McCain | |
| 7,882,967 | B2 | | 2/2011 | Hynes | |
| 2006/0065612 | A1 | | 3/2006 | Gonneville | |
| 2007/0210022 | A1 | | 9/2007 | Bianchini | |

FOREIGN PATENT DOCUMENTS

| | | | | | |
|---|---|---|---|---|---|
| DE | 2835264 | | | 2/1980 | |
| DE | 9311483 | U1 | * | 10/1993 | |
| DE | 29613332 | U1 | * | 11/1996 | |
| EP | 1029469 | A1 | * | 8/2000 | A47B 73/00 |
| FR | 1112652 | A | * | 3/1956 | |
| FR | 1599044 | A | * | 7/1970 | |
| FR | 2092246 | A5 | * | 1/1971 | |
| FR | 2192449 | A5 | * | 2/1974 | |
| FR | 2333469 | | | 7/1977 | |
| GB | 146 | | | 0/1901 | |
| GB | 943443 | A | * | 12/1963 | |
| GB | 1031205 | | | 6/1966 | |
| GB | 2221149 | A | * | 1/1990 | A47B 73/00 |

OTHER PUBLICATIONS

Official Action for U.S. Appl. No. 12/334,374, mailed Jun. 9, 2010.
Official Action for U.S. Appl. No. 12/334,374, mailed Feb. 27, 2012.
Notice of Allowance for U.S. Appl. No. 12/334,374, mailed May 17, 2012.
Official Action for U.S. Appl. No. 13/524,789, mailed Sep. 25, 2012.
Official Action for U.S. Appl. No. 13/524,789, mailed May 31, 2013.
Notice of Allowance for U.S. Appl. No. 13/524,789, mailed Nov. 14, 2013.
Official Action for U.S. Appl. No. 10/615,638, mailed Feb. 11, 2005 Restriction Requirement.
Official Action for U.S. Appl. No. 10/615,638, mailed Jul. 7, 2005.
Official Action for U.S. Appl. No. 10/615,638, mailed Oct. 31, 2005.
Notice of Allowance for U.S. Appl. No. 10/615,638, mailed Dec. 8, 2005.
Official Action for U.S. Appl. No. 11/314,575, mailed Nov. 14, 2006 Restriction Requirement.
Official Action for U.S. Appl. No. 11/314,575, mailed Jul. 26, 2007.
Official Action for U.S. Appl. No. 11/314,575, mailed Mar. 13, 2008.
Notice of Allowance for U.S. Appl. No. 11/314,575, mailed Nov. 18, 2008.
Official Action for U.S. Appl. No. 11/314,575, mailed Jan. 2, 2009.
Official Action for U.S. Appl. No. 11/314,575, mailed Nov. 18, 2009.
Notice of Allowance for U.S. Appl. No. 11/314,575, mailed Aug. 5, 2010.
Order Re: Plaintiff's Motion for Summary Judgment of Non-Infringement filed Jun. 4, 2012 19 pages.
Plaintiff's Reply to Opposition to Motion for Summary Judgment of Non-Infringement, filed May 21, 2012 (Case 2:11-cv-01543-ABC-PLA) 31 pages.
Wine Master's Opposition to Vinotemp's Motion for Summary Judgment of Non-Infringement; Declaration of John R. Posthumus, filed May 14, 2012 (Case 2:11-cv-01543-ABC-PLA) 45 pages.
Defendant's First Amended Answer and Counterclaims to Complaint for Declaratory Judgment re Patent, filed Nov. 21, 2012 (Case No. CV 12-6566 ABC PLA) 13 pages.
Complaint for Declaratory Judgment re Patent, filed Jul. 31, 2012 (Case No. CV 12-6566) 14 pages.
Plaintiff's Notice of Motion and Motion for Summary Judgment of Non-Infringment Notice of Lodging, filed Apr. 30, 2012 (Case 2:11-cv-01543-ABC-PLA) 367 pages.

* cited by examiner 94,104
110
110
110
110
112
112
60,62

94,104
60,62

94,104
114
114
114
116
116
60,62

94,104
118
118
120
120
60,62

94,104
122
122
122
122
124
124
60,62

94,104
126
60,62

94,104
130
130
128
60,62

WINE RACK

CROSS-REFERENCE TO RELATED APPLICATION

This application is a continuation of U.S. patent application Ser. No. 13/524,789 filed Jun. 15, 2012 and entitled "Wine Rack"; which is a continuation of U.S. application Ser. No. 12/334,374 filed Dec. 12, 2008 and entitled "Wine Rack", which is now U.S. Pat. No. 8,231,015; which is a continuation of U.S. patent application Ser. No. 11/314,575, filed Dec. 20, 2005 and entitled "Wine Rack" which is now U.S. Pat. No. 7,850,017; which is a continuation of U.S. patent application Ser. No. 10/615,638, filed Jul. 8, 2003, and entitled "Wine Rack" which is now U.S. Pat. No. 6,991,117; which claims the benefit under 35 U.S.C. 119(e) of U.S. provisional patent application No. 60/394,623, filed Jul. 8, 2002 and entitled "Wine Rack"; the disclosures of which are hereby incorporated herein by reference in their entireties.

FIELD OF THE INVENTION

The present invention relates, in general, to wine racks and wine racking devices.

BACKGROUND OF THE INVENTION

Conventionally, wine racks are used in wine cellars or other wine storage areas to store numerous bottles of wine in a desired area. In one example of a conventional wine rack 30 shown in FIG. 1, the bottles of wine are supported along the length of the bottle within a grid of generally rectangular cavities 32 stacked upon and next to each other, each rectangular cavity typically formed by pairs of parallel wood supports 34, 36 held in position by front and rear frame structures. In this example of a conventional wine rack, the wine rack is typically configured such that user places a bottle 38 of wine lengthwise within one of the rectangular cavities such that when the rack is full of wine bottles, only the top ends 40 (i.e., where the foil is wrapped around the top end) of the wine bottles 38 are generally visible when viewing the wine rack—and the labels on the wine bottle are not generally visible by the user. As such, in order to determine which type of wine (e.g., varietal/grape type, winery name, vintage/year, etc.) is stored in a particular cavity 32 of such a wine rack, the user may need to remove the bottle from the wine rack in order to view the label on the bottle.

As recognized by the present inventor, what is needed is a wine rack that provides storage for numerous wine bottles while permitting the user to view the label of the bottle of wine as the wine bottle rests in the wine rack.

It is against this background that various embodiments of the present invention were developed.

SUMMARY OF THE INVENTION

In light of the above and according to one broad aspect of one embodiment of the invention, disclosed herein is a wine rack that permits a user to view the wine labels on the bottles as the bottles sit in the rack. Various configurations of wine racks may be formed using embodiments of the present invention.

According to one broad aspect of one embodiment of the present invention, disclosed herein is a wine rack for attachment to a wall or other surface. In one example, the wine rack may include a first frame element for attachment to the wall; a first support member extending perpendicularly from the first frame element, the first support member having a recess portion for supporting a first portion of a wine bottle (i.e., a portion of the neck); a second frame element for attachment to a wall; and a second support member extending perpendicularly from the second frame element, the second support member having a recess portion for supporting a second portion of a wine bottle (i.e., a portion of the body of the bottle). When the wine bottle is placed in the rack, the label of the wine bottle may be seen and read by person standing in front of the wine rack.

In one embodiment, the first support member may include a second recess portion for supporting a first portion of a second wine bottle. The second support member may include a second recess portion for supporting a second portion of the second wine bottle. In another example, the first support member may include a third recess portion for supporting a first portion of a third wine bottle, and the second support member may include a third recess portion for supporting a second portion of a third wine bottle. The first and second support members may be formed from steel rods. In one example, the first and second frame elements may be positioned in a parallel relation to each other. The recess portion of the support members may take many different shapes such as U-shaped, V-shaped or other shapes.

According to another broad aspect of another embodiment of the invention, disclosed herein is a wine rack for mounting on a wall or other surface, the wine rack including at least a first and second pair of support members. In one embodiment, the first pair of support members may support at least a first and a second wine bottle in a substantially parallel relation to the wall, wherein the second bottle is positionable proximate the wall, and wherein the label of the first wine bottle is visible to a person standing in front of the wine rack. The second pair of support members may support at least a third and a fourth wine bottle in a substantially parallel relation to the wall, wherein the fourth bottle is positionable proximate the wall, and wherein the label of the third wine bottle is visible to the person standing in front of the wine rack.

In one example, the first pair of support members may extend perpendicularly relative to the wall surface, each of said first pair of support members having a first recess for supporting a portion of the first wine bottle and a second recess for supporting a portion of the second wine bottle. In another example, the second pair of support members may extend perpendicularly relative to the wall surface, each of said second support members having a first recess for supporting a portion of the third wine bottle and a second recess for supporting a portion of the fourth wine bottle.

According to another broad aspect of another embodiment of the invention, disclosed herein is a support member for a wine rack having a vertically oriented frame portion. In one embodiment, the support member may include a first end adapted to be attached in a perpendicular orientation to the vertically oriented frame portion; a shaft portion extending from the first end; and a recess portion for supporting a portion (such as the neck or body) of a wine bottle, the recess portion having a downwardly sloped portion and an upwardly shaped portion, the downwardly shaped portion being coupled with the shaft portion.

In one example, the support member may be a steel rod, and may have a round cross section. The recess portion may be implemented as a U-shape, V-shape or other shapes.

In another example, the support member may also include an end portion coupled with the upwardly shaped portion of the recess, wherein the end portion terminates on a distal end with an upwardly extending tip.

In another example, the support member may also include an intermediate portion having a first end and a second end, the first end coupled with the upwardly shaped portion of the recess portion, and a second recess portion having a downwardly sloped portion and an upwardly shaped portion, the downwardly shaped portion being coupled with the second end of the intermediate portion. An end portion may be coupled with the upwardly shaped portion of the second recess, wherein the end portion terminates on a distal end with an upwardly extending tip.

Alternatively, the support member may include a second intermediate portion having a first end and a second end, the first end coupled with the upwardly shaped portion of the second recess portion, and a third recess portion having a downwardly sloped portion and an upwardly shaped portion, the downwardly shaped portion being coupled with the second end of the second intermediate portion. In this example, the support member may include an end portion coupled with the upwardly shaped portion of the third recess, wherein the end portion terminates on a distal end with an upwardly extending tip.

Other embodiments of the invention are disclosed herein. The foregoing and other features, utilities and advantages of various embodiments of the invention will be apparent from the following more particular description of the various embodiments of the invention as illustrated in the accompanying drawings and claims.

DETAILED DESCRIPTION

According to one embodiment of the present invention, disclosed herein is a wine rack for supporting multiple bottles of wine for storage in a manner that allows for the labels of one or more bottles stored in the rack to be visible to a person viewing the wine rack. Various different configurations of wine racks are possible, and the wine racks may be formed by attachment to walls, ceilings, or other surfaces or structures.

Figure 1:
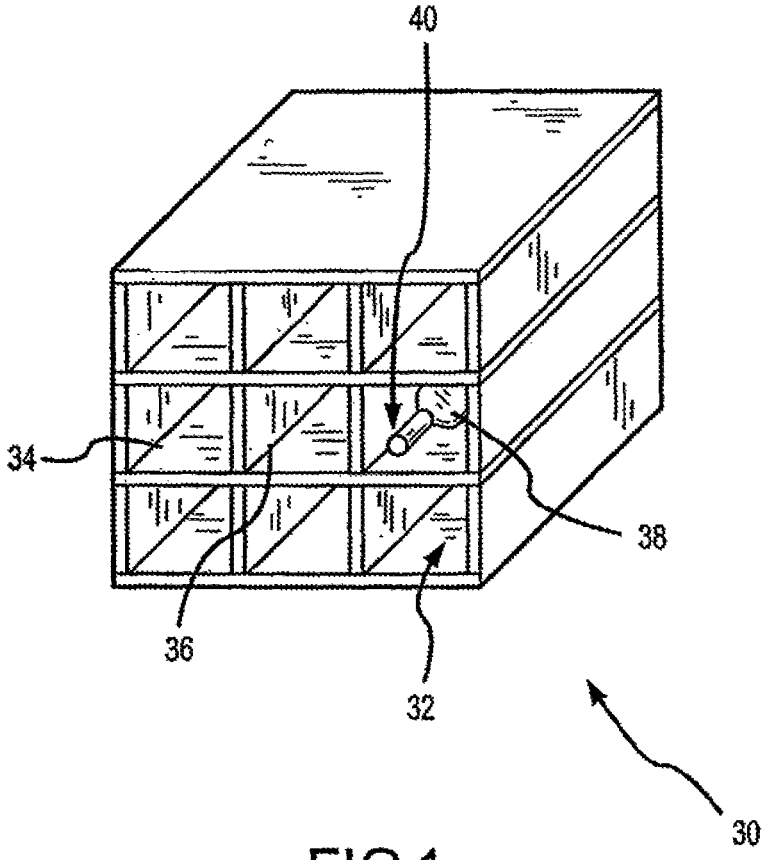
FIG.1 PRIOR ART
FIG. 1 illustrates an example of a conventional wine rack.
Figure 2:
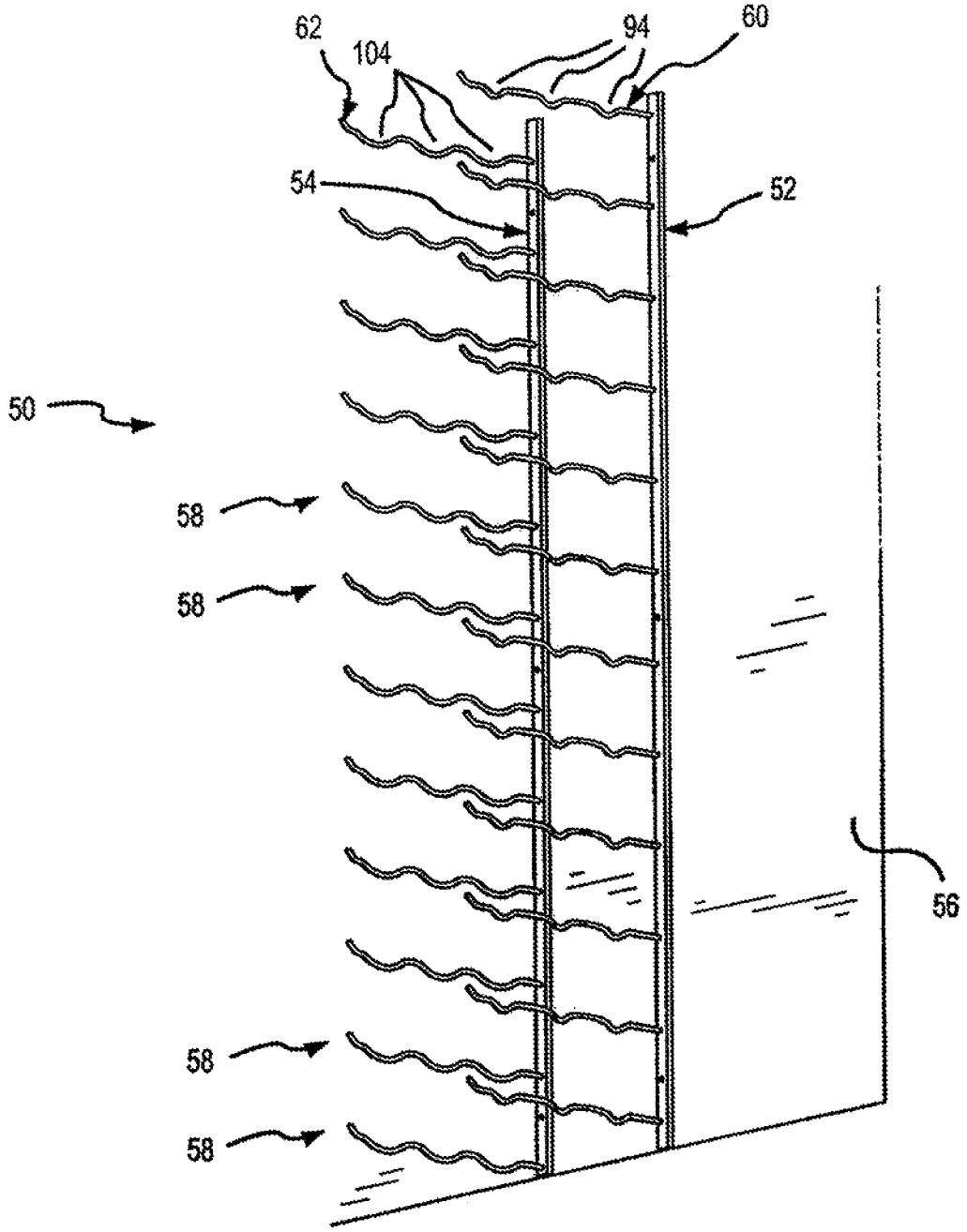
FIG. 2 illustrates an example of a wine rack, in accordance with an embodiment of the present invention.

As shown in the accompanying drawings such as FIG. 2, a wine rack 50 may include a first frame element 52 and a second frame element 54, wherein, in one example, the first and second frame elements are adapted to be secured to a wall 56 or other surface, preferably positioned vertically along the wall surface 56 in a parallel arrangement to one another. Various rows 58 of the wine rack 50 are formed, wherein each row 58 has at least a first and second support member 60, 62, preferably each support member 60, 62 attached to and extending perpendicularly from a respective frame element 52, 54.

Each pair of the support members 60, 62 in a row 58 support at least one bottle of wine (and may support two or three or more bottles of wine as shown below) in a generally horizontal position and in a parallel relation to the wall surface 56 so that the labels of one or more bottles (i.e., the front-most bottle stored in each row) stored in the rack 50 are visible to a person viewing the wine rack. Hence, a user of the wine rack 50 can easily see the labels of many, and possibly all, of the bottles of wine stored in the wine rack. Using the frame elements 52, 54 and support members 60, 62, various different configurations of wine racks 50 are possible—for instance, the size (i.e., capacity) of the rack 50 can be varied, the number of rows can be varied, the number of bottles per row can be varied, the rack 50 can be varied to support different size bottles of wine (i.e., standard 750 ml, magnum 1.5 liter, half bottles 375 ml, champagne bottles, pinot noir bottles, etc.), and other characteristics of the wine rack 50 can be varied. Various embodiments of the invention will now be described.

As shown in FIG. 2, a wine rack 50 having 12 rows in this example is formed using a first and second frame element 52, 54 from which, for each row, a first and second support member 60, 62 extend perpendicularly therefrom. The system in FIG. 2 is adapted to support 3 wine bottles per row. The wine bottle to be stored is placed to rest on the first and second support members 60, 62 which are supported by the frame elements 52, 54.

While FIG. 2 shows each row 58 adapted to support 3 bottles, it is understood that each row could be designed to support 1, 2, 3 or more bottles, depending upon the implementation. As shown herein, a number of various configurations of the wine rack are possible depending on the particular implementation.

Figure 3:
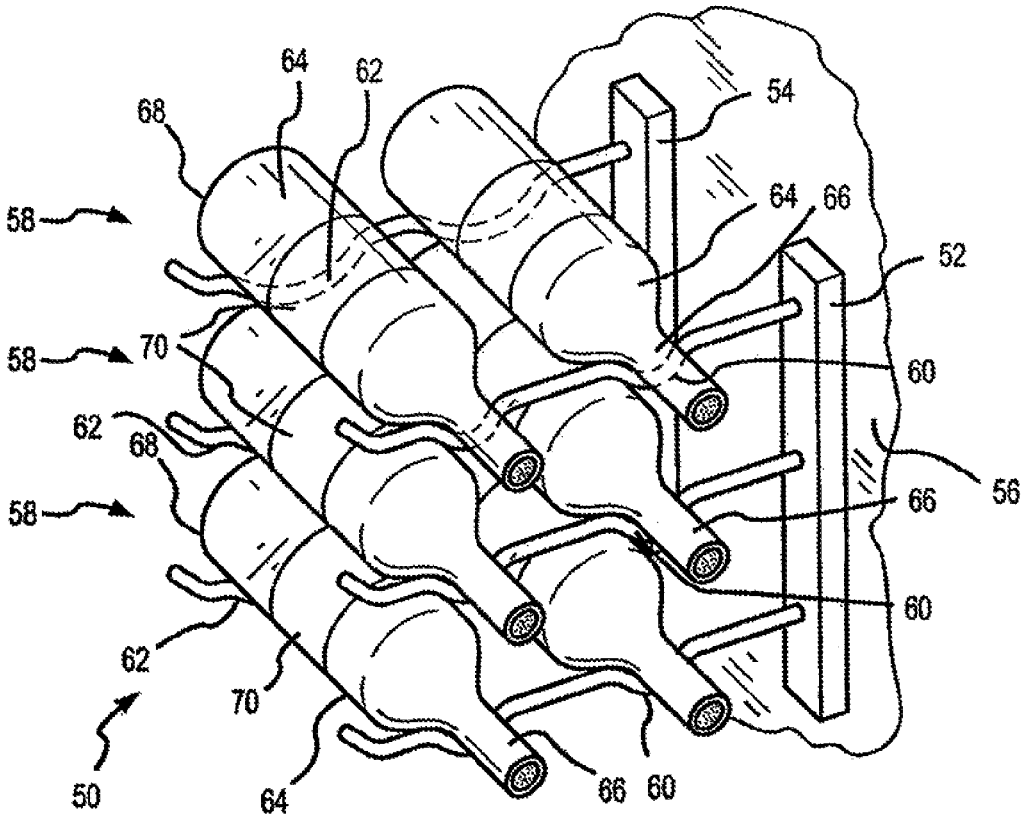
FIG. 3 illustrates another example of a wine rack with wine bottles resting therein with the labels of the bottles visible, in accordance with an embodiment of the present invention.

FIG. 3 illustrates a portion of an example of a wine rack 50 having a first and second frame element 52, 54 attached in parallel relation to a wall 56. In FIG. 3, three rows 58 of wine bottles 64 are shown, wherein each row 58 supports two wine bottles 64. On the top row, a first support member 60 extends perpendicularly from the first frame element 52 for supporting the necks 66 of the wine bottles in the top row, and a second support member 62 extends perpendicularly from the second frame element 54 for supporting a portion of the body 68 of the bottle 64. The wine bottles of the top row are positioned with the rear bottle behind the front bottle, and can be arranged such that the label 70 of the front bottle may be visible to a person standing in front of the wine rack 50. A portion of the label of the rear bottle of the top row may be visible to a person standing in front of the wine rack as well.

In the middle row of FIG. 3, a first support member 60 extends perpendicularly from the first frame element 52 for supporting the necks 66 of the wine bottles 64 in the middle row, and a second support member 62 extends perpendicularly from the second frame element 54 for supporting a portion of the body 68. The wine bottles 64 of the middle row are positioned with the rear bottle behind the front bottle, and can be arranged such that the label 70 of the front bottle may be visible to a person standing in front of the wine rack. A portion of the label of the rear bottle of the middle row may be visible to a person standing in front of the wine rack as well.

In the bottom row of FIG. 3, a first support member 60 extends perpendicularly from the first frame element 52 for supporting the necks 66 of the wine bottles in the bottom row, and a second support member 62 extends perpendicularly from the second frame element 54 for supporting a portion of the body 68. The wine bottles 64 of the bottom row are positioned with the rear bottle behind the front bottle, and can be arranged such that the label 70 of the front bottle may be visible to a person standing in front of the wine rack. A portion of the label of the rear bottle of the bottom row may be visible to a person standing in front of the wine rack as well. While FIG. 3 illustrates 3 rows in the rack 50, it is understood that the number of rows in the wine rack is a matter of choice and can be greater or less than 3 rows, as desired.

Figure 4:
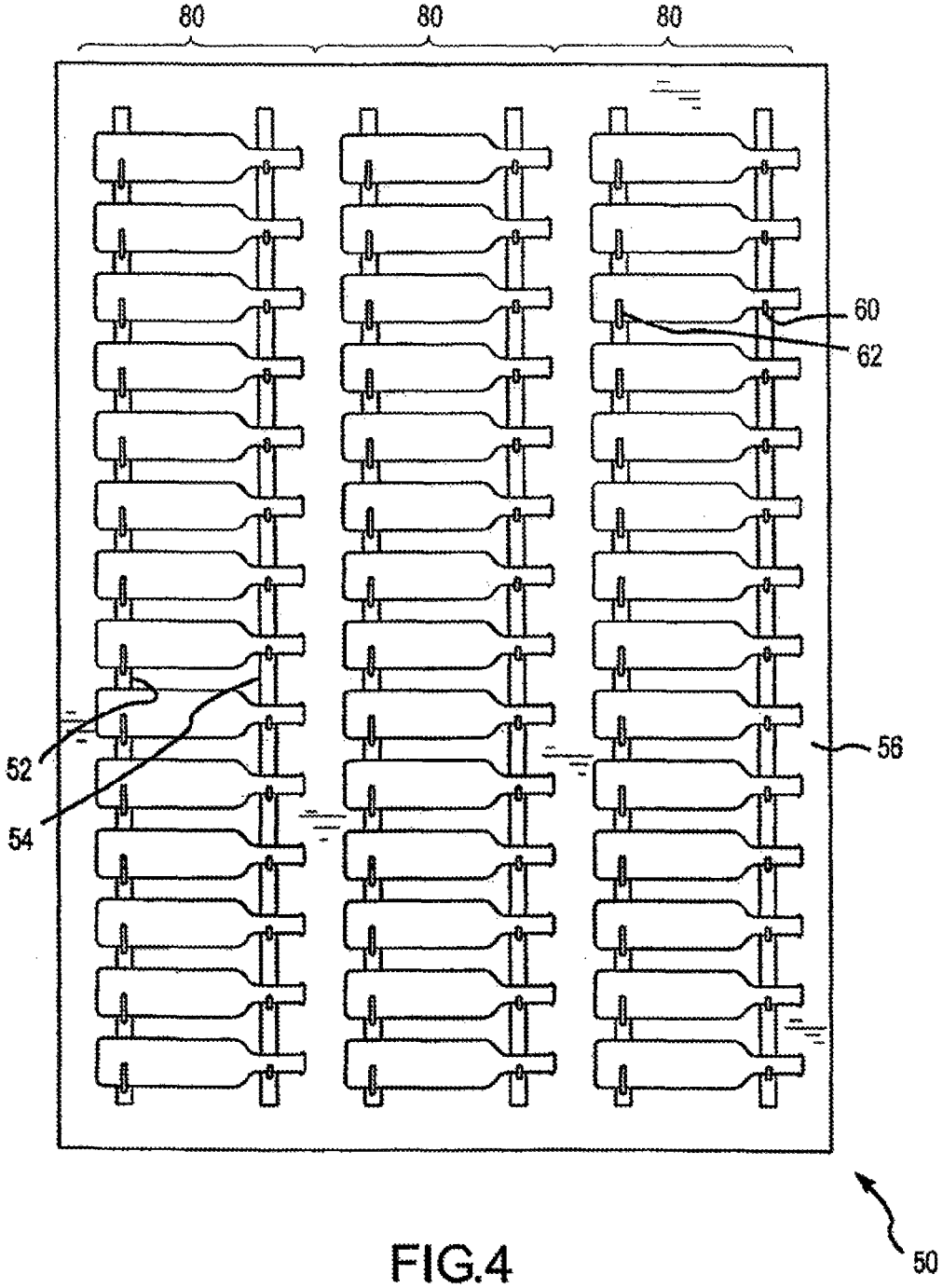
FIG. 4 illustrates another example of a wine rack with wine bottles resting therein with the labels of the bottles visible, in accordance with an embodiment of the present invention.

FIG. 4 illustrates an example of a wine rack 50 that may be formed using embodiments of the present invention. As shown in FIG. 4, three sets 80 of frame elements 52, 54 are attached in parallel to a wall 56 wherein each pair 80 of frame elements 52, 54 has fourteen pairs of support members extending therefrom, thereby providing a 42 bottle wine rack if each pair of support members supports a single bottle. As described above, the example of FIG. 4 may also be designed to support two or three wine bottles per pair of support members, thereby increasing the capacity of the example of FIG. 4 to 84 wine bottles or 126 wine bottles, depending upon the particular implementation.

Figure 5:
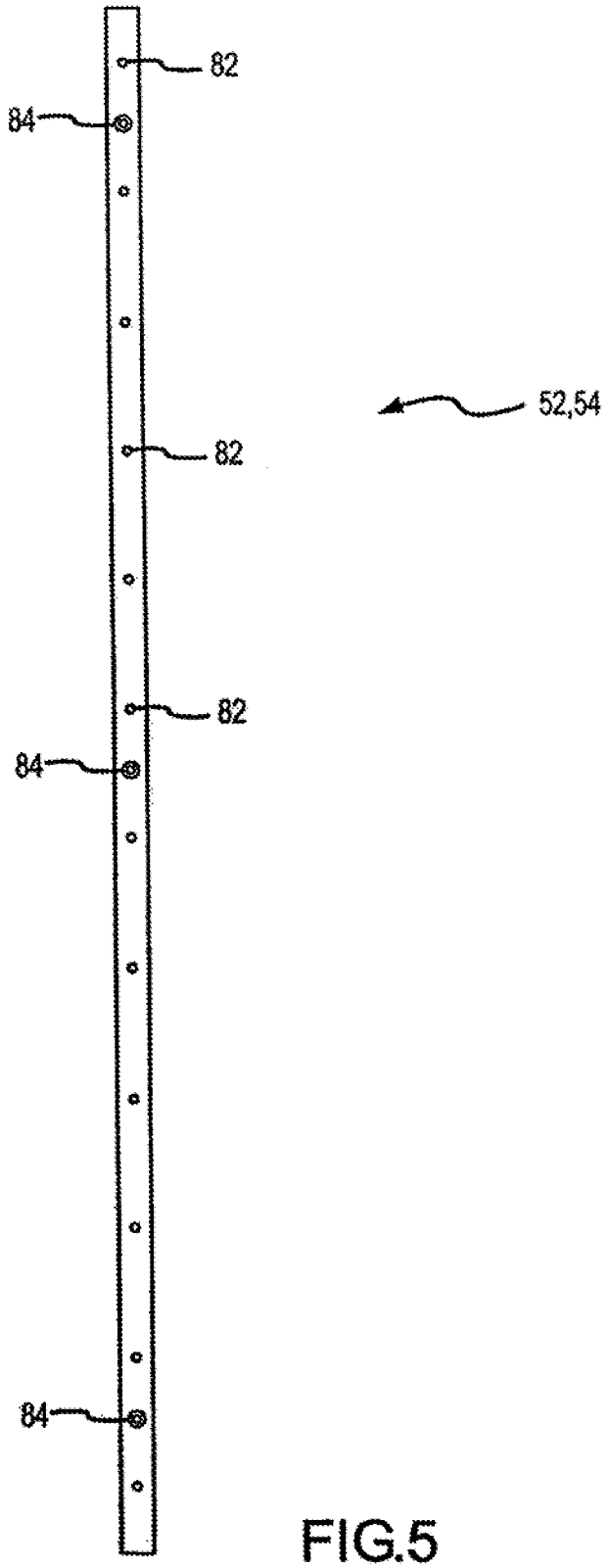
FIG. 5 illustrates an example of a frame element, in accordance with an embodiment of the present invention.

FIG. 5 illustrates an example of a frame element or strip (52 or 54) having a plurality of holes 82 adapted to receive a support member rod 60, 62, and a plurality of holes 84 for receiving a fastener 86 (not shown) to fasten the frame element 52, 54 to a surface such as a wall. In one example, the frame elements 52, 54 may be made from oil pickled ASTM A500 rectangular steel framework pieces.

For example, for each frame element or strip 52, 54, there may be six pre-drilled points 84 for fasteners 86 which are used to secure the frame element to a surface such as a wall. In one example, each fastener 86 may be selected so as to support approximately twenty pounds, primarily in sheer or vertical force. The top fastener of a frame element 52, 54 typically experiences the greatest amount of horizontal force tending to pull the frame element from the wall or other surface, and accordingly, during installation, the top fastener of the frame element should be secured solidly between the frame element and the wall or other surface.

Different fasteners 86 may be used to secure the frame elements to a surface (i.e., a wall) and may vary based on the type of surface that the frame element is being attached. Although various fasteners or securing means 86 may be used to attach a frame element 52, 54 to a surface such as a wall, number 10 woodscrews, two inches long, along with spiral inserts or toggle bolts may be used with surfaces such as wood or drywall. For surfaces such as concrete or stucco over concrete, tapcons such as 3/16 inch×1¾ or 2¼ may be used, for example.

Also, while the first and second frame elements 52, 54 are shown as attaching to a wall, it is understood that they may be attached to some structure other than a wall or may be provided with legs to be supported from the floor, or may be supported from a ceiling.

As shown in the examples of FIGS. 2 and 6-11, the rows of a wine rack 50 may include a first and second support member 60, 62. Depending on the configuration of the support members, each row can support one, two, three or more bottles of wine. A first support member 60 may be used to support a portion of the neck 66 of the wine bottle, and a second support member 62 may be used to support a portion of the body 68 of the wine bottle. These support members can take different shapes, as shown and described herein.

Figure 6:
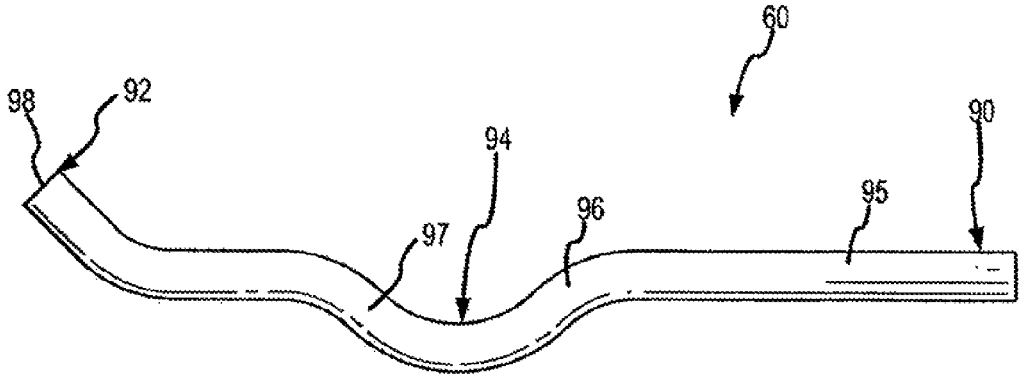
FIG. 6 illustrates an example of a support member for supporting a portion of a neck of a wine bottle, in accordance with an embodiment of the present invention.

In one example and as shown in FIGS. 2 and 6, the first support member 60 is fixed on one end 90 to a portion of the first frame element 52, and the first support member is free on the other end 92. The first support member 60 has a recess or downwardly curved indentation 94 adapted to receive or support a portion of the neck 66 of the wine bottle, as shown in FIG. 6.

Figure 7:
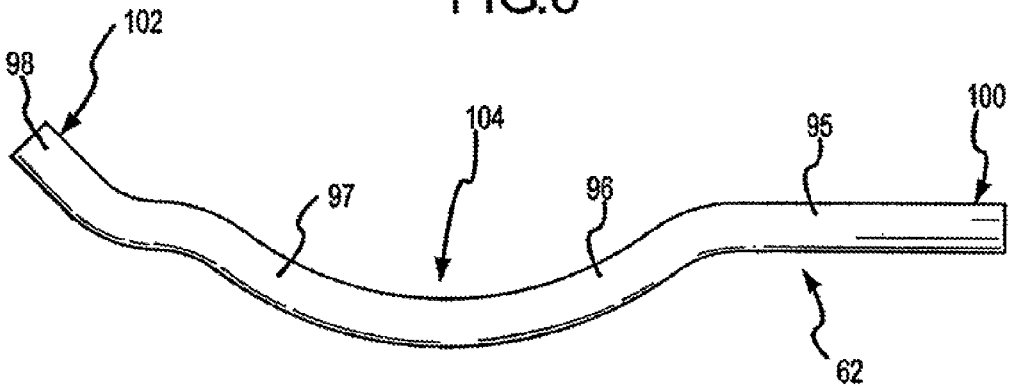
FIG. 7 illustrates an example of a support member for supporting a portion of a body of a wine bottle, in accordance with an embodiment of the present invention.

In one example, the second support member 62 is, on one end 100, fixed to the second frame element 54, and has a free end 102. In FIG. 7, the second support member 62 has a recess or downwardly curved indentation 104 adapted for receiving or supporting a portion of the body portion 68 of the bottle.

The first and second support members 60, 62 are positioned relative to one another along the frame elements 52, 54 such that a wine bottle 64 can be rested or positioned to rest on the respective recesses 94, 104 of the first and second support members 60, 62. In one example, the first and second support members 60, 62 are welded to the respective frame elements 52, 54 such that the support members extend perpendicularly from the frame elements.

In one example, the support members 60, 62 may be made using the high tensile ASTM A1018 cold rolled steel rods. Preferably, the support members 60, 62 are welded to the frame elements 52, 54 using gas tungsten ark welding (TIG) and/or gas metal arc welding (MIG) technologies, and a powder coating may be provided and baked on to the support members and frame elements for providing a durable and attractive finish, such a green, pewter, and may be further treated to provide a brushed steel appearance.

In one example, the free end 92, 102 of the one or both of the support members 60, 62 may be provided with a cap or rubber bumper to cover the free end of the support member.

Figure 9:
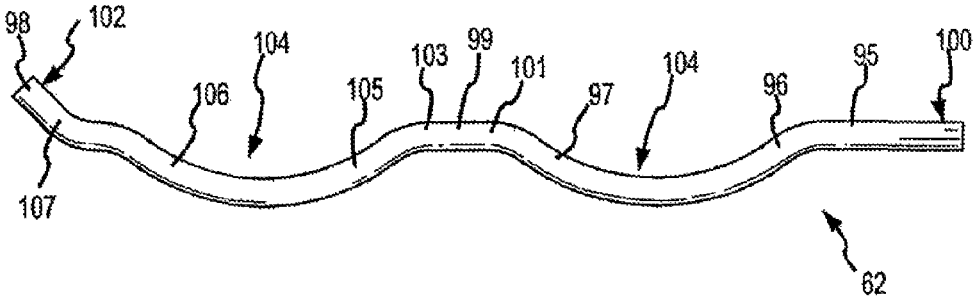
FIG. 9 illustrates an example of a support member of FIG. 7, for supporting the body portions of two bottles of wine, in accordance with an embodiment of the present invention.
Figure 10:
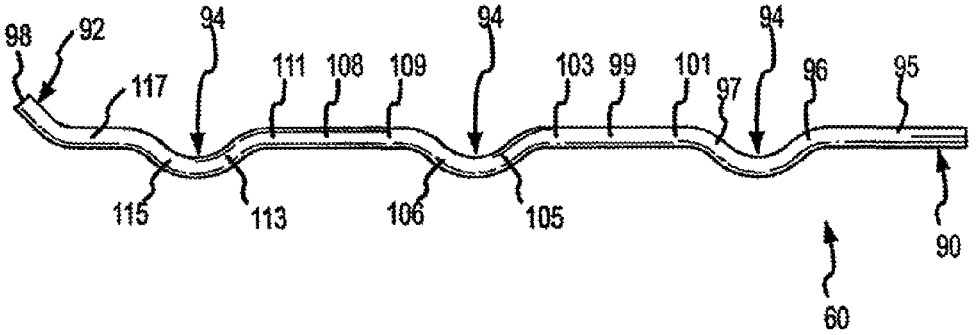
FIG. 10 illustrates another example of a support member of FIG. 6, for supporting the neck portions of three bottles of wine, in accordance with an embodiment of the present invention.
Figure 11:
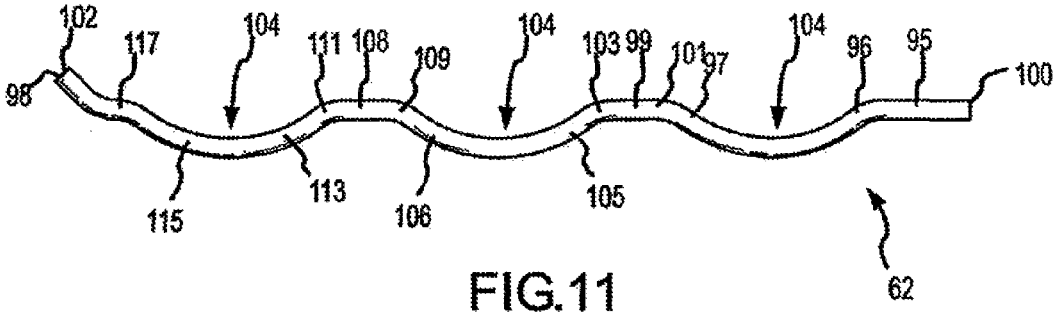
FIG. 11 illustrates another example of a support member of FIG. 7, for supporting the body portions of three bottles of wine, in accordance with an embodiment of the present invention.

In one example and as shown in FIGS. 2 and 10-11, the first and second support members 60, 62 each have three recesses (94 and 104) so that a wine rack 50 can support three wine bottles per row. Alternatively, the first and second support members may be provided with one recess (94 and 104) to support one bottle per row (see FIGS. 6-7), or may be provided with two recesses (94 and 104) per support member as shown in FIGS. 8-9 to support two bottles per row.

The support members 60, 62 may be provided with recesses 94, 104. As shown in the examples of FIGS. 6-7, the support members 60, 62 may include a first end adapted 90, 100 to be attached in a perpendicular orientation to a vertically oriented frame portion 52, 54. A shaft portion 95 extends from the first end 90, 100 and a recess portion 94, 104 is coupled with the shaft portion 95. The recess portion 94, 104 supports a portion (such as the neck or body) of a wine bottle, and the recess portion 94, 104 may have a downwardly sloped or shaped portion 96 and an upwardly shaped portion 97, the downwardly shaped portion 96 being coupled with the shaft portion 95. As shown in FIGS. 6-7 and 12-21, the recess portions 94, 104 may be implemented as different shapes, such as U-shaped, V-shaped or other shapes.

As shown in FIGS. 6-7, the support members 60, 62 may also include an end portion 92, 102 coupled with the upwardly shaped portion 97 of the recess 94, 104, wherein the end portion 102 terminates on a distal end with an upwardly extending tip 98.

Figure 8:
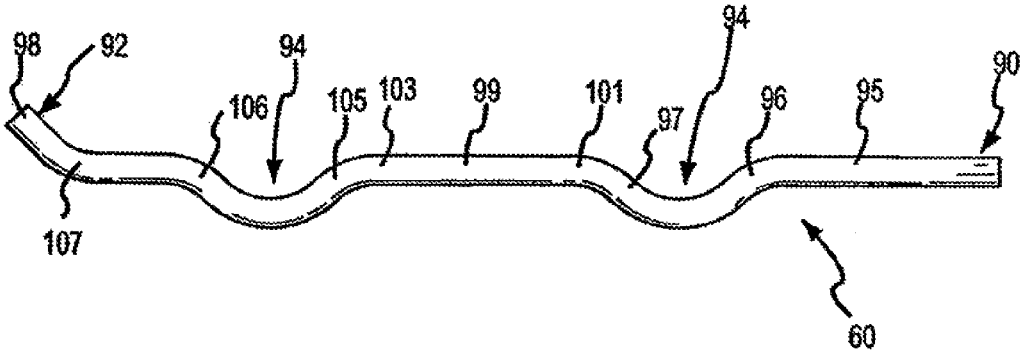
FIG. 8 illustrates another embodiment of a support member of FIG. 6, for supporting the neck portions of two bottles of wine, in accordance with an embodiment of the present invention.

In another example of FIGS. 8-9, the support members 60, 62 may also include an intermediate portion 99 having a first end 101 and a second end 103, the first end 101 coupled with the upwardly shaped portion 97 of the recess portion 94, 104, and a second recess portion (also shown as 94, 104) having a downwardly sloped portion 105 and an upwardly shaped portion 106, the downwardly shaped portion 105 being coupled with the second end 103 of the intermediate portion 99. An end portion 107 may be coupled with the upwardly shaped portion 106 of the second recess, wherein the end portion terminates on a distal end with an upwardly extending tip 98.

Alternatively, as shown in FIGS. 10-11, the support members 60, 62 may include a second intermediate portion 108 having a first end 109 and a second end 111, the first end 109 coupled with the upwardly shaped portion 106 of the second recess portion, and a third recess portion (also shown as 94, 104) having a downwardly sloped portion 113 and an upwardly shaped portion 115, the downwardly shaped portion 113 being coupled with the second end 111 of the second intermediate portion 108. In this example, the support members 60, 62 may include an end portion 117 coupled with the upwardly shaped portion 115 of the third recess, wherein the end portion terminates on a distal end with an upwardly extending tip 98.

Because the support members 60, 62 may be designed to support a single bottle, two bottles deep, or three bottles deep, for example, various different configurations and capacities for wine racks can be made. For example, in a single deep design (i.e., one bottle per row), the rods 60, 62 holding the bottles 64 may be spaced four inches apart and may be five and a half inches long, in one example. Where the wine rack is designed for supporting two bottles per row (i.e., two bottles deep), the rods 60, 62 may be spaced four inches apart and may be eight and a half inches long each, in one example. Where the wine rack is a three bottle deep design (i.e., three bottles per row), the rods 60, 62 holding the bottles may be spaced four inches apart and be twelve inches long each, in one example.

The support members 60, 62 have a generally round or circular cross-section, or may have square, rectangular, triangular, or other differently shaped cross-sections. Further, the support members 60, 62 may take various shapes as shown in FIGS. 12-21. FIGS. 12-21 illustrate various different shapes that can be used when forming the support members 60 or 62 and the recesses (94 or 104) therein and may be used for supporting either a portion of the neck 66 or body 68 of a wine bottle 64. It is understood that these are by way of example only.

Figures 12, 13, 14, 15, 16, 17, 18:
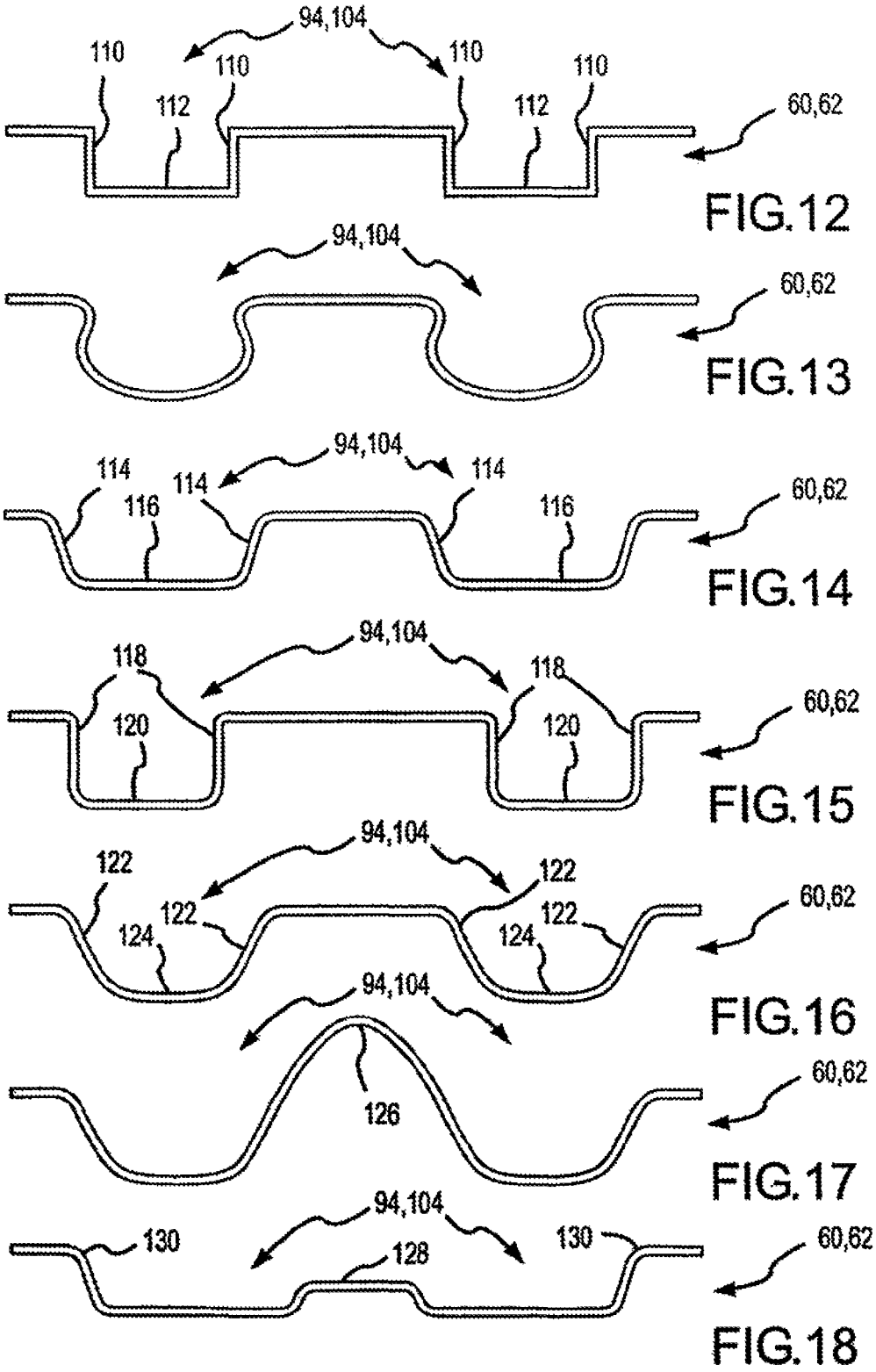
FIG. 12 illustrates another embodiment of a support member, in accordance with an embodiment of the present invention.
FIG. 13 illustrates another embodiment of a support member, in accordance with an embodiment of the present invention.
FIG. 14 illustrates another embodiment of a support member, in accordance with an embodiment of the present invention.
FIG. 15 illustrates another embodiment of a support member, in accordance with an embodiment of the present invention.
FIG. 16 illustrates another embodiment of a support member, in accordance with an embodiment of the present invention.
FIG. 17 illustrates another embodiment of a support member, in accordance with an embodiment of the present invention.
FIG. 18 illustrates another embodiment of a support member, in accordance with an embodiment of the present invention.

In FIG. 12, the support member (60 or 62) has a pair of recesses (94 or 104) that are defined by flat or straight sidewalls 110 and a flat or straight lower portion 112. In FIG. 13, each recess 94, 104 is defined by a circular or oval shape, while in FIG. 14 each recess 94, 104 is defined by straight sidewalls 114 that form an obtuse angle relative to the lower portion 116. In FIG. 15, each recess 94, 104 has straight sidewalls 118 and a curved lower portion 120, while in FIG. 16, each recess 94, 104 has angled sidewalls 122 and a curved lower portion 124. In FIG. 17, each recess 94, 104 is generally curved and between recesses, an upwardly curved portion connects 126 the first recess to the second recess. In FIG. 18, the portion 128 between the recesses is shaped so as to prevent a bottle from moving from the first recess to the second recess, and in this example, the height of the intermediate portion 128 is lower than the height of the end portions 130 of the support member.

Figure 19:
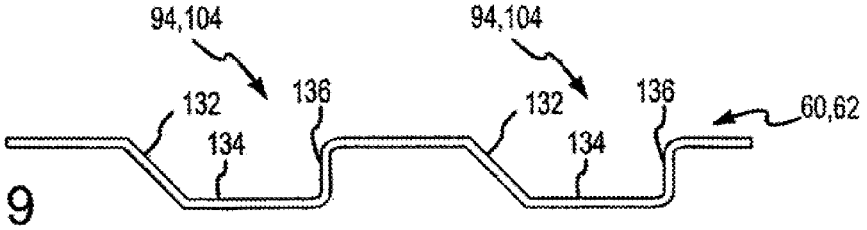
FIG. 19 illustrates another embodiment of a support member, in accordance with an embodiment of the present invention.
Figure 20:
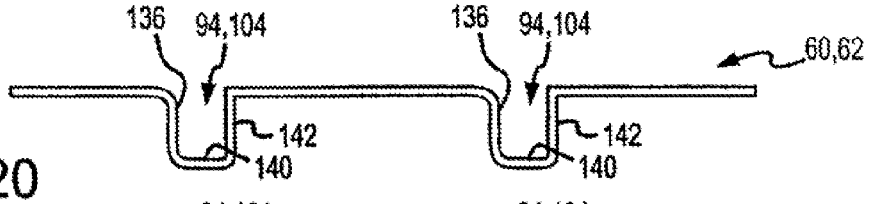
FIG. 20 illustrates another embodiment of a support member, in accordance with an embodiment of the present invention.
Figure 21:
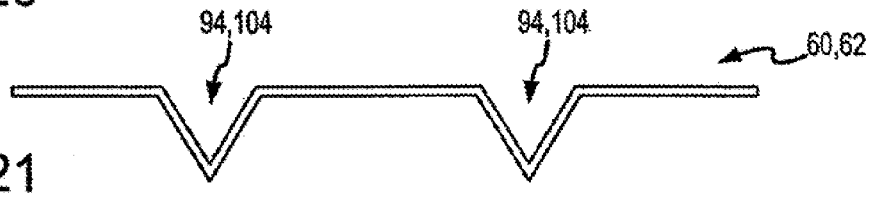
FIG. 21 illustrates another embodiment of a support member, in accordance with an embodiment of the present invention.

In FIG. 19, each recess 94, 104 is defined by a first slanted or angled sidewall 132 joined to a flat lower portion 134 joined to a straight sidewall 136, while in FIG. 20, each recess 94, 104 has a front curved sidewall 138 and a curved lower portion 140 which joins to a straight rear sidewall 142. In both FIGS. 19 and 20, the front sidewall 132, 138 of each recess assists in placement of the bottle within the recess 94, 104. In FIG. 21, the recesses 94, 104 are generally V-shaped.

Embodiments of the present invention can be utilized to support wine bottles of differing sizes, including standard sized wine bottles of 750 ml, magnum sized wine bottles of 1.5 liters, and half bottles of 375 ml. Other wine bottle sizes may be supported utilizing embodiments of the present invention as well. For instance, 375 ml bottles are typically nine and a half inches long, and therefore ten to eleven inches per row can be allocated in a layout. For 750 ml bottles, which are typically twelve inches long, thirteen to fourteen inches per row may be allocated. For magnum 1.5 liter bottles which are typically fourteen inches long, fifteen to sixteen inches per row may be allocated.

As an example of a layout for a wine rack 50 for supporting standard 750 ml bottles on a wall 56 that is eleven and a half feet long, eleven and a half feet (which is 132 inches) divided by thirteen inches per row yields 10.15. This means that ten sets 80 of racks may be utilized with approximately one inch extra on each end of each rack.

Starting from the left side of the wall, a frame element 54 may be coupled with a support member 62 for supporting the larger end of the wine bottle should be placed a minimum of three inches from the end of the wall, and the next frame element 52 adapted for receiving the support member 60 (for supporting the neck of the bottle) should be placed seven and a half inches from the frame element 54 for a standard 750 ml bottle. For a 375 ml bottle, the distance may be six inches from the first strip; and for a 1.5 liter bottle, the distance may be ten inches from the first strip. For the second set 80 of frame elements positioned on the wall, a frame element 54 of this second set may be placed five and a half to six and a half inches for a standard 750 ml bottle from the frame element 52 of the first set of frame elements, for example (and for a 375 ml bottle, four to five inches from the frame element 52 of the first set 80 of frame elements; and for a 1.5 liter bottle, the distance may be five to six inches from the frame element 52 of the first set of frame elements). In this example, these dimensions are referenced from the center of a frame element to the center of the next frame element.

Figure 22:
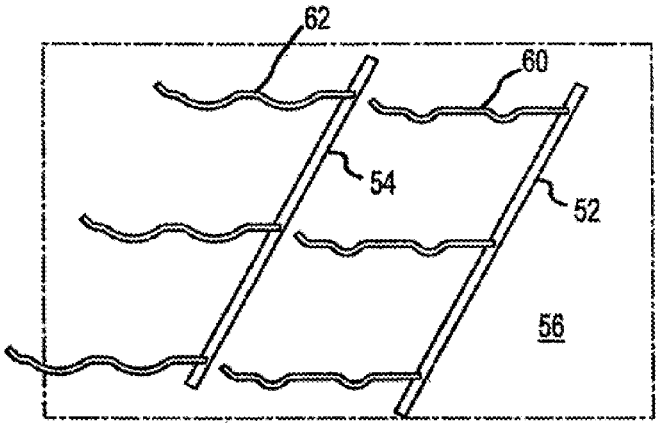
FIG. 22 illustrates a wine rack wherein the frame elements are attached at an angle to the wall or surface, in accordance with an embodiment of the present invention.

While FIG. 2 illustrates the frame elements 52, 54 aligned vertically with respect to the wall 56 or other surface, a wine rack 50 may be formed wherein the frame elements 52, 54 may be positioned in non-vertical orientations. FIG. 22 illustrates another embodiment wherein the frame elements 52, 54 are mounted to a surface 56 at an angle.

Figure 23:
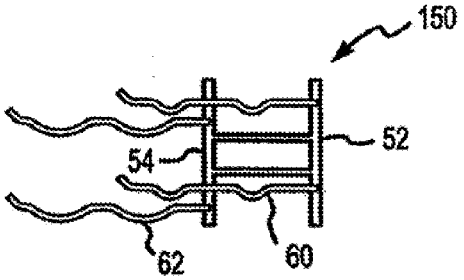
FIG. 23 illustrates a wine rack wherein the frame elements are interconnected, in accordance with an embodiment of the present invention.
Figure 24:
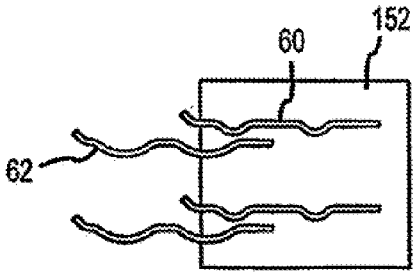
FIG. 24 illustrates a wine rack wherein the support members are connected to a support surface in lieu of frame elements, in accordance with an embodiment of the present invention.

Further, in place of first and second frame elements 52, 54 as shown in FIG. 2, a wine rack 50 may be formed using a single unitary frame element 150 having a first and second portion 52, 54 for respectively receiving the first support member 60 and the second support member 62, as shown in FIG. 23, or a surface 152 may be used as shown in FIG. 24 for receiving securably the first and second support members 60, 62 of a row of a wine rack in accordance with embodiments of the present invention. The surface 152 may be integral to a wall 56 or may attach to a wall 56.

Figure 25:
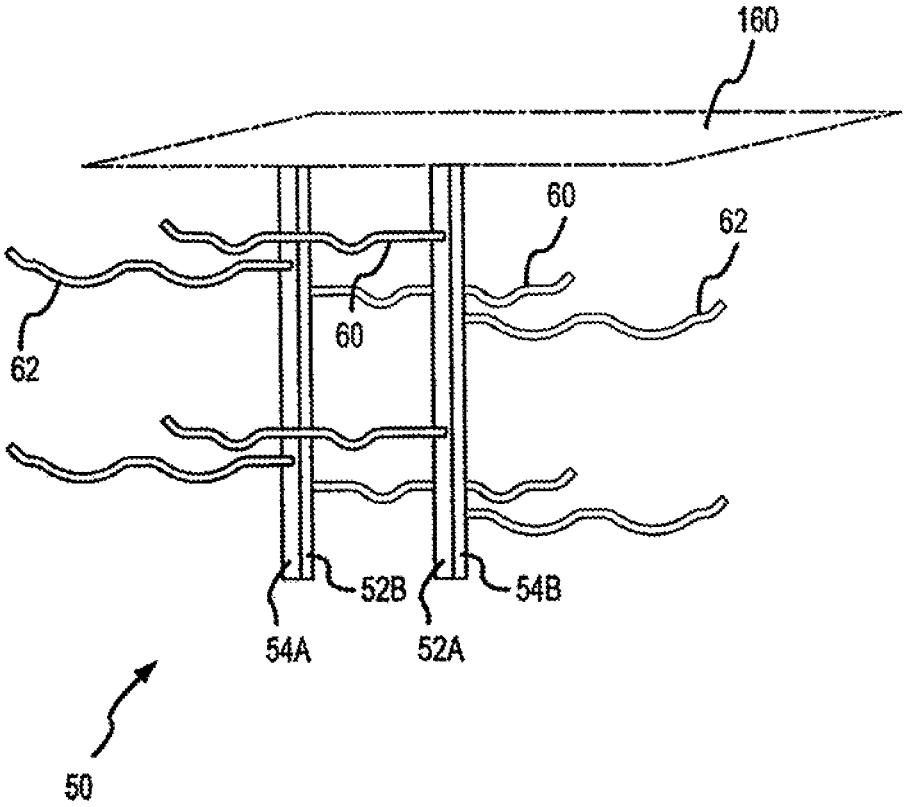
FIG. 25 illustrates a wine rack wherein the frame elements are connected to a ceiling, in accordance with an embodiment of the present invention.

Further, a wine rack 50 may be formed using embodiments of the present invention that attaches to the ceiling 160 of a room. For instance and as shown in FIG. 25, a first pair of frame elements (including first and second frame elements 52A, 54A) can be secured to a ceiling joist or an I-beam and suspended therefrom. In this way, a wine rack can be formed that gives the appearance of hanging down from the ceiling. If desired, a second pair of frame elements 52B, 54B can also be secured from ceiling structures and this second pair of frame elements 52B, 54B can be securably attached to the back or rear of the first pair 52A, 54A of frame elements so as to create a two-sided wine rack suspended from a ceiling.

In another embodiment, a band may be included to secure a wine bottle to one or more of the support members 60, 62, such as a band that would extend over and across the wine bottle. This would secure the wine bottle 64 in the rack 50 to prevent the bottle from moving during a small earthquake or other disturbance.

Accordingly, it can be seen from the various embodiments shown and described herein that when compared with conventional wine racking systems—such as wood wine racks where the bottle is positioned axially within a compartment of the racking—embodiments of the present invention provide for improved air circulation around each bottle, as well as provide easy viewing of the labels of bottles in the rack 50.

All directional references used herein (e.g., upper, lower, upward, downward, left, right, leftward, rightward, top, bottom, above, below, vertical, horizontal, clockwise, and counterclockwise) are only used for identification purposes to aid the reader's understanding of the present invention, and do not create limitations, particularly as to the position, orientation, or use of the invention.

While the invention has been particularly shown and described with reference to various embodiments thereof, it will be understood by those skilled in the art that various other changes in the form and details may be made without departing from the spirit and scope of the invention.

What is claimed is:

1. A wine rack comprising:

(a) a first wine bottle support member having:

(i) a proximal portion extending from a substantially vertical planar surface, (ii) a first recessed portion extending from the proximal portion, the first recessed portion adapted to support a list portion of a first wine bottle;

(iii) a first intermediate portion extending from the first recessed portion;

(iv) a second recessed portion extending from the first intermediate portion, the second recessed portion adapted to support a first portion of a second wine bottle; and (v) a free end portion;

(b) a second wine bottle support member having:

(i) a proximal portion extending from the substantially vertical planar surface, (ii) a first recessed portion extending from the proximal portion, the first recessed portion adapted to support a second portion of the first wine bottle;

(iii) a first intermediate portion extending from the first recessed portion;

(iv) a second recessed portion extending from the first intermediate portion, the second recessed portion adapted to support a second portion of the second wine bottle; and (v) a free end portion, wherein the proximal portions of both the first and second wine bottle support members are oriented substantially horizontally, and the first and second wine bottle support members are adapted to hold the first wine bottle substantially perpendicular to the proximal portions thereof.

2. The wine rack of claim 1, wherein the free end portion of the first and second wine bottle support members includes an upwardly extending tip.

3. The wine rack of claim 1, wherein the first wine bottle support member and the second wine bottle support member are adapted to hold the first and second wine bottles in a substantially horizontal orientation.

4. The wine rack of claim 1, (i) wherein the first recessed portion and the second recessed portion of the first wine bottle support member each trace a first arc portion of a first circle; and (ii) wherein the first recessed portion and the second recessed portion of the second wine bottle support member each trace a second arc portion of a second circle.

5. The wine rack of claim 1, wherein the substantially vertical planar surface is the surface of a wall.

6. The wine rack of claim 1, the first wine bottle support member further having:

(vi) a second intermediate portion extending from the second recessed portion; and (vii) a third recessed portion extending from the second intermediate portion, the third recessed portion adapted to support a first portion of a third wine bottle; and the second wine bottle support member further having:

(vi) a second intermediate portion extending from the second recessed portion; and (vii) a third recessed portion extending from the second intermediate portion, the third recessed portion adapted to support a second portion of the third wine bottle.

7. The wine rack of claim 6, wherein the free end portion of the first and second wine bottle support members includes an upwardly extending tip.

8. The wine rack of claim 6, wherein the first wine bottle support member and the second wine bottle support member are adapted to hold the first, second, and third wine bottles in a substantially horizontal orientation.

9. The wine rack of claim 6, (i) wherein the first recessed portion, the second recessed portion, and the third recessed portion of the first wine bottle support member each trace a first arc portion of a first circle; and (ii) wherein the first recessed portion, the second recessed portion, and the third recessed portion of the second wine bottle support member each trace a second arc portion of a second circle.

10. The wine rack of claim 6, wherein the substantially vertical planar surface is the surface of a wall.

11. A wine rack comprising:

(a) a first frame element adapted to be attached to a structure;

(b) a second frame element adapted to be attached to the structure in parallel to the first frame element;

(c) a first wine bottle body support member having:

(i) a proximal portion extending perpendicularly from the first frame element;

(ii) a first recessed portion extending from the proximal portion, the first recessed portion adapted to support a wine bottle body;

(iii) an intermediate portion parallel to the proximal portion and extending from the first recessed portion;

(iv) a free end portion extending from the intermediate portion;

(d) a second wine bottle body support member having:

(i) a proximal portion extending perpendicularly from the second frame element;

(ii) a first recessed portion extending from the proximal portion, the first recessed portion adapted to support a wine bottle body;

(iii) an intermediate portion extending from the first recessed portion;

(iv) a free end portion extending from the intermediate portion; and (e) wherein the first and second wine bottle support members are adapted to hold a first wine bottle substantially perpendicular to the proximal portions thereof.

12. The wine rack of claim 11, wherein the free end portion of the first and second wine bottle body support members includes an upwardly extending tip.

13. The wine rack of claim 11, wherein when the first and second frame elements are oriented vertically, the proximal portions of both the first and second wine bottle body support members are oriented horizontally.

14. The wine rack of claim 11, wherein when the first and second frame elements are oriented horizontally, the proximal portions of both the first and second wine bottle body support members are oriented horizontally.

* * * * *